US005979620A

United States Patent [19]

Lurie et al.

[11] Patent Number: 5,979,620

[45] Date of Patent: Nov. 9, 1999

[54] REPLACEMENT WINDOW DISPLAY CASE

[75] Inventors: Neil Lurie, New York; Eric Seger, Wantagh; Lajos Meszaros, Huntington, all of N.Y.

[73] Assignee: Bragley Manufacturing Co., Inc., Brooklyn, N.Y.

[21] Appl. No.: 08/926,406

[22] Filed: Sep. 9, 1997

[51] Int. Cl.[6] ..... A45C 3/00

[52] U.S. Cl. ..... 190/16; 248/166

[58] Field of Search ..... 312/305, 312; 108/149.19, 148, 106; 248/176.1, 166; 190/16

[56] References Cited

U.S. PATENT DOCUMENTS

| | | | |
|---|---|---|---|
| 2,707,538 | 5/1955 | Mayer, Sr. et al. | 190/16 |
| 2,935,165 | 5/1960 | Elliot . | |
| 3,124,225 | 3/1964 | Rosenberg . | |

*Primary Examiner*—Gary E. Elkins
*Assistant Examiner*—Tri M. Mai
*Attorney, Agent, or Firm*—Collard & Roe, P.C.

[57] ABSTRACT

A display case for a replacement window, comprising a case assembly and frame member. The case assembly has a front panel and a rear panel hingedly connected to each other near their top edges, and having an inwardly directed flange connected to their side edges. The frame member secures a replacement window therein and is slidably inserted within the case assembly. The frame member comprises two side sections, a top section and a bottom section. Each side section has at least one longitudinally-extending channel on its external surface for sliding engagement with a flange on the case assembly. The case assembly has means for preventing opening of the hinged connection beyond a predetermined maximum point. There is a plank attached to said bottom section of the frame and extending along its length. The plank has outwardly beveled longitudinal edges so as to create a groove between the bottom section of the frame and the bottom of each beveled edge. Sliding the frame out of the case assembly and opening the hinged connections to their maximum point causes the top edges of the panels to engage the grooves and lock the frame in an extended position. Closing the panels releases the grooves and allows the frame to slide within the case assembly for transportation and storage.

11 Claims, 5 Drawing Sheets

REPLACEMENT WINDOW DISPLAY CASE

BACKGROUND OF THE INVENTION

1. Field of the Invention

This invention relates to a portable display assembly for replacement windows. In particular, the invention relates to a portable display assembly that serves as a cover for a replacement window during transportation and also as a stand to display the window at a convenient height.

2. The Prior Art

Portable display assemblies have been used by vendors of replacement windows to sell their wares door-to-door. These assemblies serve both as a cover for the replacement window as it is being transported or stored, and as a stand for displaying the window at a convenient height.

U.S. Pat. Nos. 2,935,165 to Elliott and 3,124,225 to Rosenberg disclose demonstration devices of the type described above, which comprise an interior frame connected to an outer housing which has a front panel and a rear panel. The front and rear panels are hinged together and provide a supporting stand for the inner frame. The frame can be slid within the stand to convert the stand and frame combination into a portable carrying case for the frame. The frame is supported on the stand by a triangular notch cut in the sides of the frame, which rests against the edges of the stand when the frame is in the open position.

While these devices provide a convenient way to transport and display replacement windows, they suffer from several drawbacks. The main problem is that the mechanism for holding the frame in an upright position on the stand is not durable or steady. The frame can easily become disengaged from the stand and slide down between the panels. Second with frequent use over time, the moving, sliding parts easily wear out and/or come loose.

SUMMARY OF THE INVENTION

It is therefore an object of the present invention to provide a display frame of the type described above that is extremely stable in the open position.

It is another object of the present invention to provide a display frame that is durable, even with frequent and long term use.

It is yet another object of the present invention to provide a display frame that can be used with even very large replacement windows without inconveniencing the user.

These and other objects of the invention are provided by a display case for a replacement window, comprising a case assembly and frame member. The case assembly has a front panel and a rear panel hingedly connected to each other near their top edges, and has a longitudinally-extending inwardly-directed flange connected to their side edges. The case assembly has means for preventing opening of the hinged connection beyond a predetermined maximum point.

The frame member secures a replacement window therein and is slidably inserted within the case assembly. The frame member comprises two side sections, a top section and a bottom section. The frame preferably has a channel running around its inside surface for securing a replacement window therein. The frame is assembled around the window so that the window is permanently mounted within the frames.

In addition, the side sections have at least one longitudinally-extending channel on its external surface for sliding engagement with a flange on the case assembly, There are preferably two channels, so that each flange on the case assembly engages a separate channel.

There is a plank attached to the bottom section of the frame and extending along its length. The plank has outwardly beveled longitudinal edges so as to create a groove between the bottom section of the frame and the bottom of each beveled edge. The side sections of the frame preferably extend beyond the bottom section and plank to add additional stability to the frame when the frame is extended outside the case assembly.

Sliding the frame out of the case assembly and opening the panels via their hinged connections to their maximum point causes the top edges of the panels to engage the grooves and lock the frame in an extended position. Closing the panels releases the grooves and allows the frame to slide within the case assembly.

There is least one handle attached to at least one side of the case assembly, to allow for easy transportation of the display case. Preferably, there are two padded handles attached to the flanges along one side of the case assembly. In addition, there is preferably an additional handle attached to the top section of the frame, to enable the frame to be easily slide in and out of the case assembly.

The hinged connection between the panels is preferably comprised of a steel plate pivotally mounted to each of the two panels, and a spring connecting the two panels above the steel plate. The spring forces the top edges of the panels together, and the bottom ends of the panels into an open position when the frame is extended out of the case assembly.

A plurality of resilient spacing brackets are preferably attached to the side sections of the frame for facilitating smooth sliding of the frame within the case assembly. These brackets can be of any conventional type. Furthermore, any other type of device to facilitate smooth sliding of the frame can also be used.

The means for preventing the opening of the hinged connection beyond a predetermined maximum point preferably comprises two rigid arms pivotally mounted to each other at one end thereof. The other ends of the arms are then and pivotally mounted to opposing side edges of the panels. This way, when the panels are folded together, the arms pivot and assume a v-shaped position, to allow for closing of the panels. The panels may be opened until the arms are unfolded and assume a straight linear position, at which point they prevent the panels from opening any further. The degree to which the panels may be opened is determined by the length of the arms.

To ensure that the case is durable, the flanges are preferably formed from steel. The spring and arms on the case assembly are preferably formed from steel as well. The rest of the case i.e., the panels and the frame, are preferably made from wood or particle board. However, other materials, such as plastic, fiberglass or graphite could also be used.

The frame can be dimensioned to slide completely within the case assembly for carrying, or can be made longer than the panels of the case assembly. In this case, the case assembly further comprises a cover flap hingedly connected to the top edge of each panel. Each cover flap is equipped with means, such as a clasp or latch for releasably securing the cover flap to the frame. This way, when the frame is slid within the case assembly, the cover flaps are raised and secured to the frame to cover any portion of the frame remaining outside the case assembly.

This embodiment is preferable when the frame is dimensioned to hold very large windows. With such large windows, the height to which the frame needs to be raised to display the window would be too great for an average salesperson to raise. Thus, this way, the salesperson needs only to raise the window an equivalent of a portion of its height to display the window.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 3:
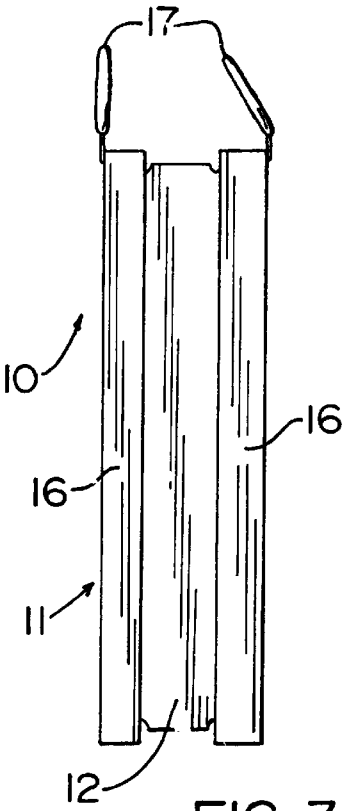
FIG. 3 is a bottom view of the case according to the invention.
Figure 1:
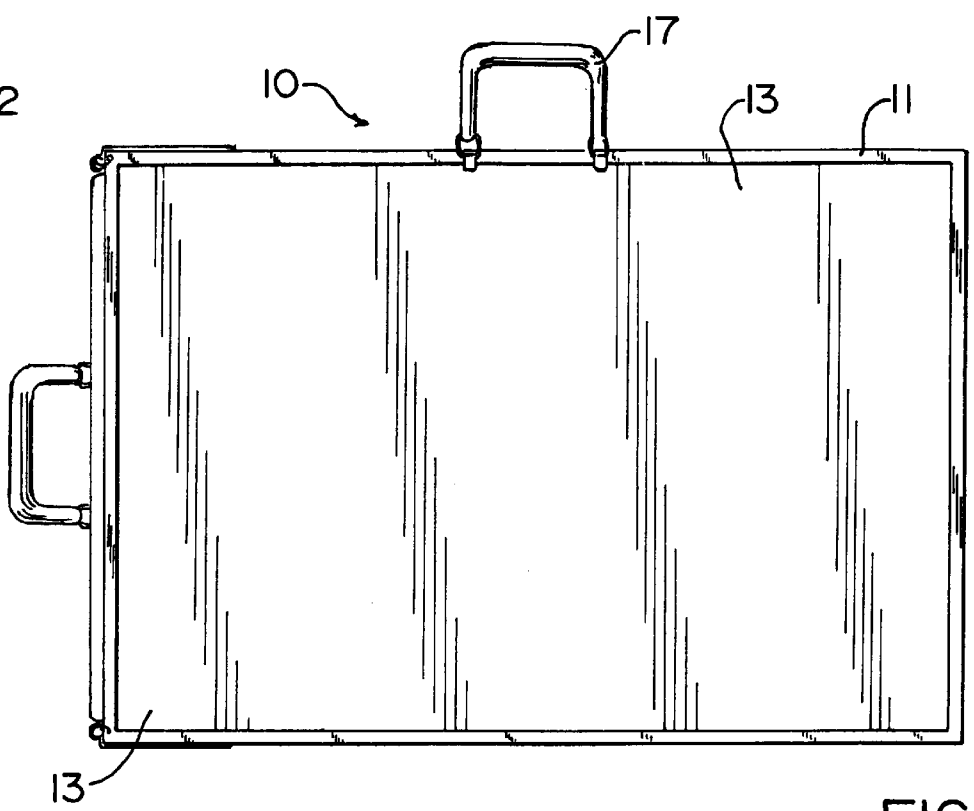
FIG. 1 is a front view of the case according to the invention in the closed position.

Turning now in detail to the drawings, and in particular, FIGS. 1–4, there is shown the display case 10 according to the invention, in the closed position. Case 10 has two major components, a case assembly 11, and a window frame 12, which is slidably disposed within case assembly 11. Case assembly 11 is comprised of two panels 13 which are hingedly connected together on each side by a spring 14 and a pivotally mounted plate 15, which is attached via rivets 28.

Panels 13 are each equipped with a set of inwardly-directed steel flanges 16 running around their side and bottom edges. A set of handles 17 are attached to the flanges on one of the side edges of panels 13, to facilitate carrying case 10. An additional handle 18 is attached to the top section of frame 12, and facilitates the sliding of frame 12 into and out of case assembly 11.

Figure 5:
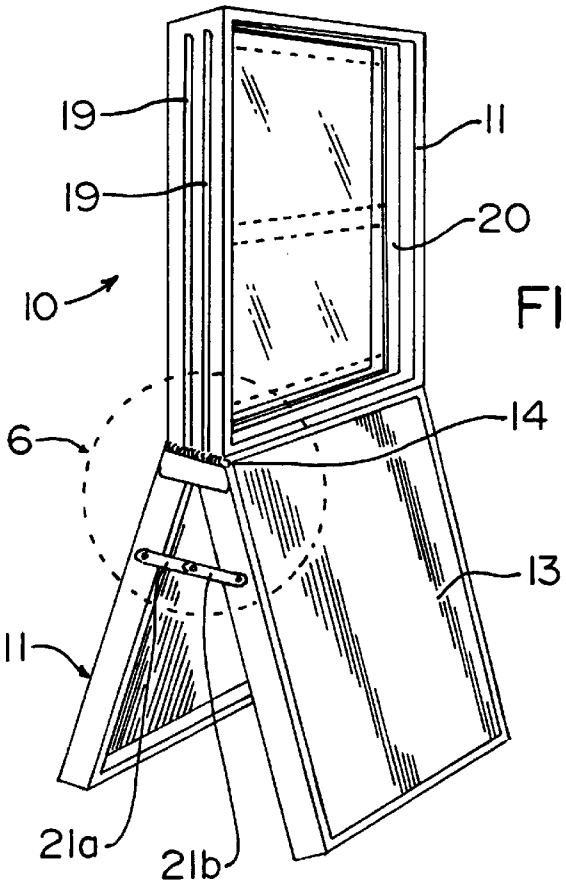
FIG. 5 is a perspective view of the case according to the invention in the open position.
Figure 8:
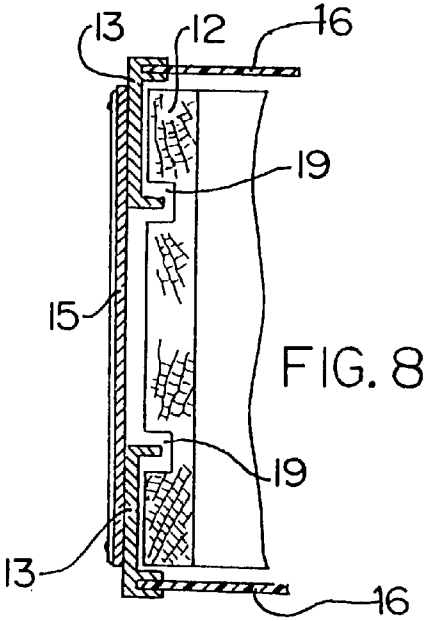
FIG. 8 is a sectional view along line 8—8 of the case as shown in FIG. 7.
Figure 9:
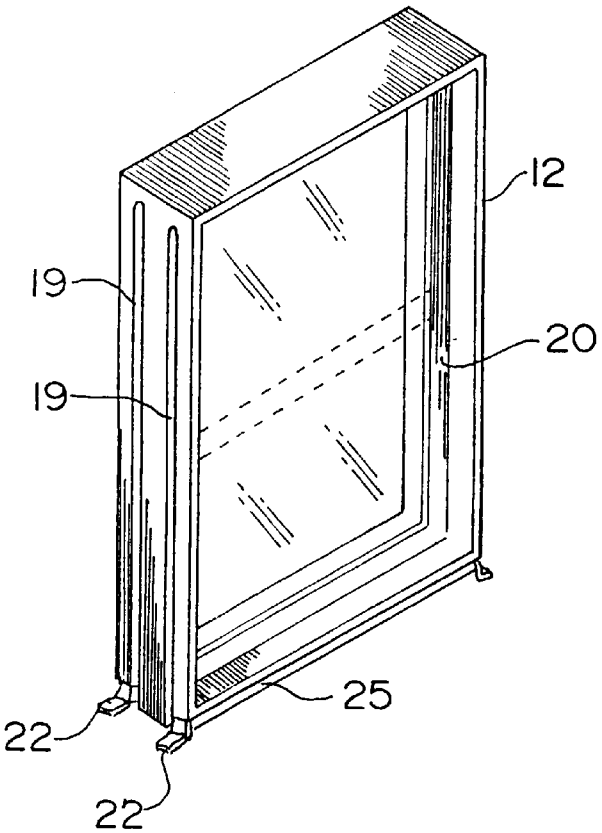
FIG. 9 is a perspective view of the frame according to the invention.

As shown in FIGS. 5–9, frame 12 is equipped with two channels 19 running along the outer surface of its side sections. Channels 19 engage flanges 16 and keep frame 12 slidably disposed between panels 13, as shown in FIG. 8. Frame 12 also has a channel 20 running around its inside surface, as shown in FIGS. 5 and 9, for retaining a replacement window (not shown) therein. Frame 12 is assembled around a replacement window so that the window is permanently mounted within flanges 20.

FIG. 5 shows case 10 in its open position, with frame 12 extended outside case assembly 11. To extend frame 12, the user simple grasps handle 18 and pulls upward on frame 12, sliding it out of case assembly 11. Once flanges 16 on case assembly 11 are released from channels 19 on frame 12, panels 13 are pushed outwardly by spring 14, and pivot into an easel-like position. Panels 13 then serve as a convenient stand for displaying a replacement window within frame 12.

Figure 2:
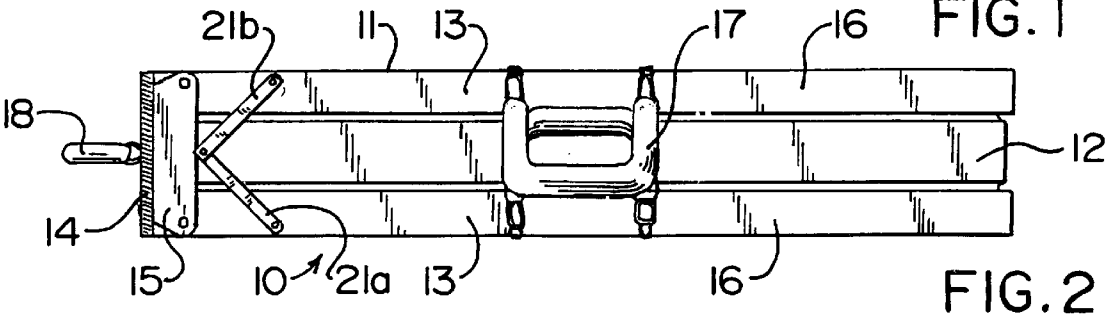
FIG. 2 is a side view of the case according to the invention.
Figure 4:
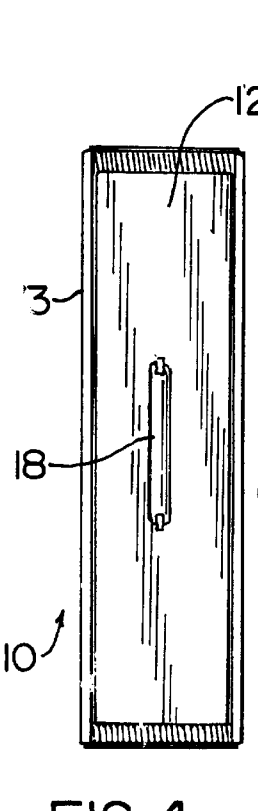
FIG. 4 is a top view of the case according to the invention.
Figure 6:
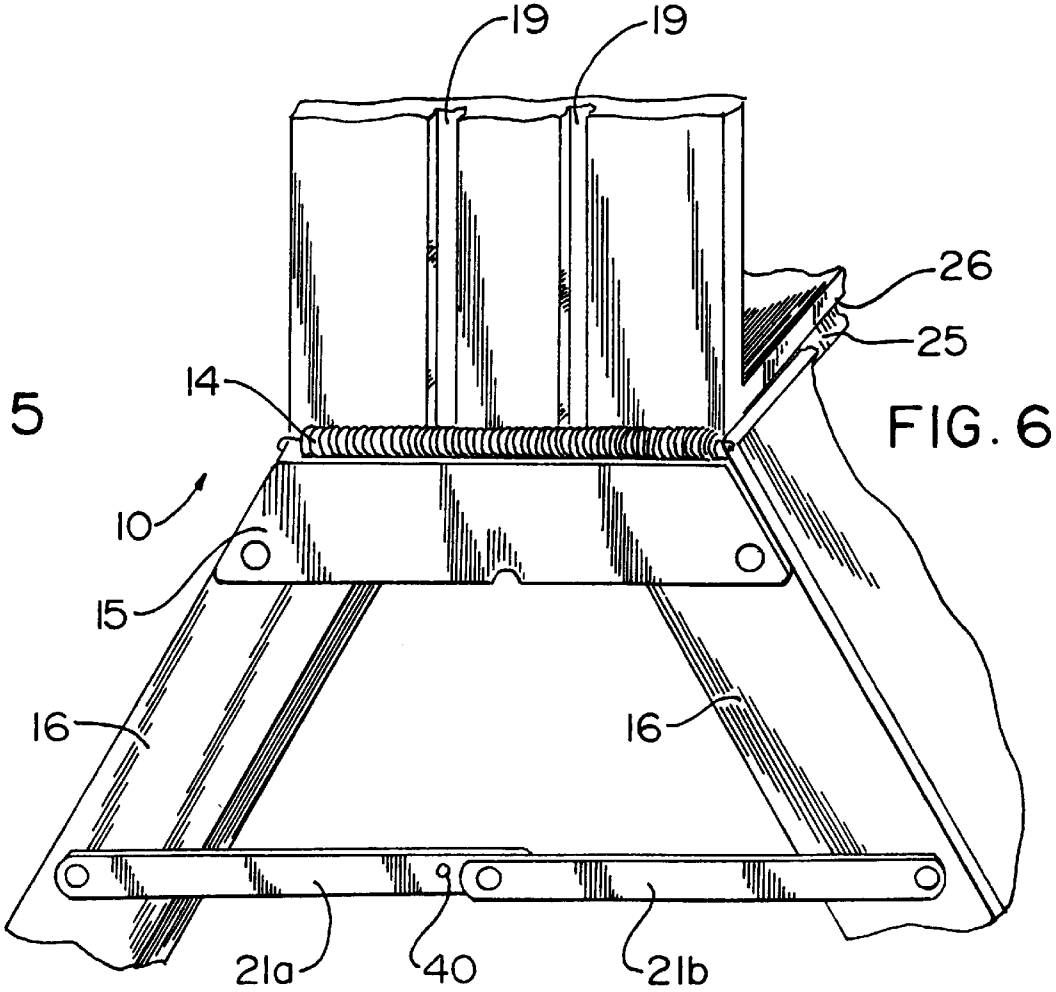
FIG. 6 is an enlarged view of a section of the case shown in FIG. 5.
Figure 7:
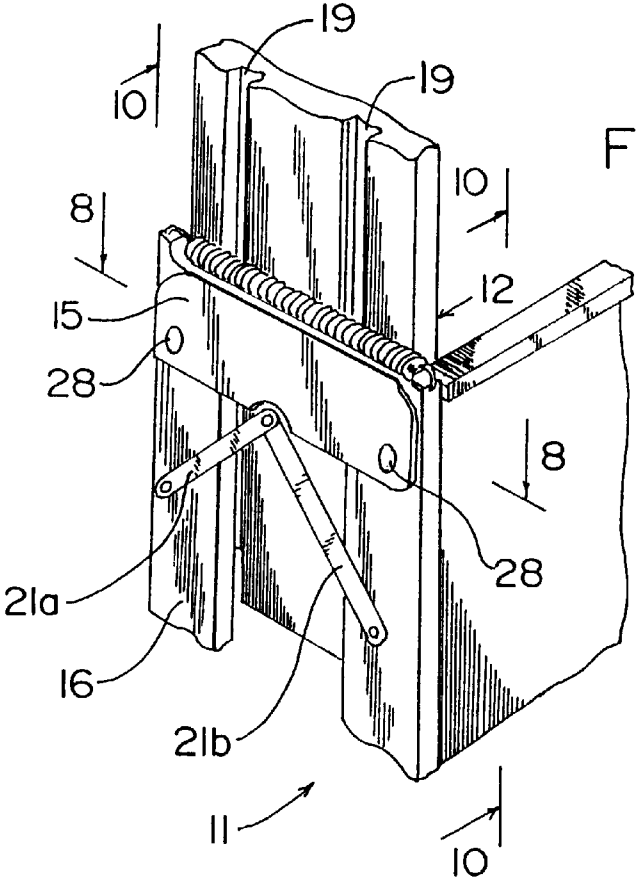
FIG. 7 is a view of the section shown in FIG. 6 in the closed position.
Figure 13:
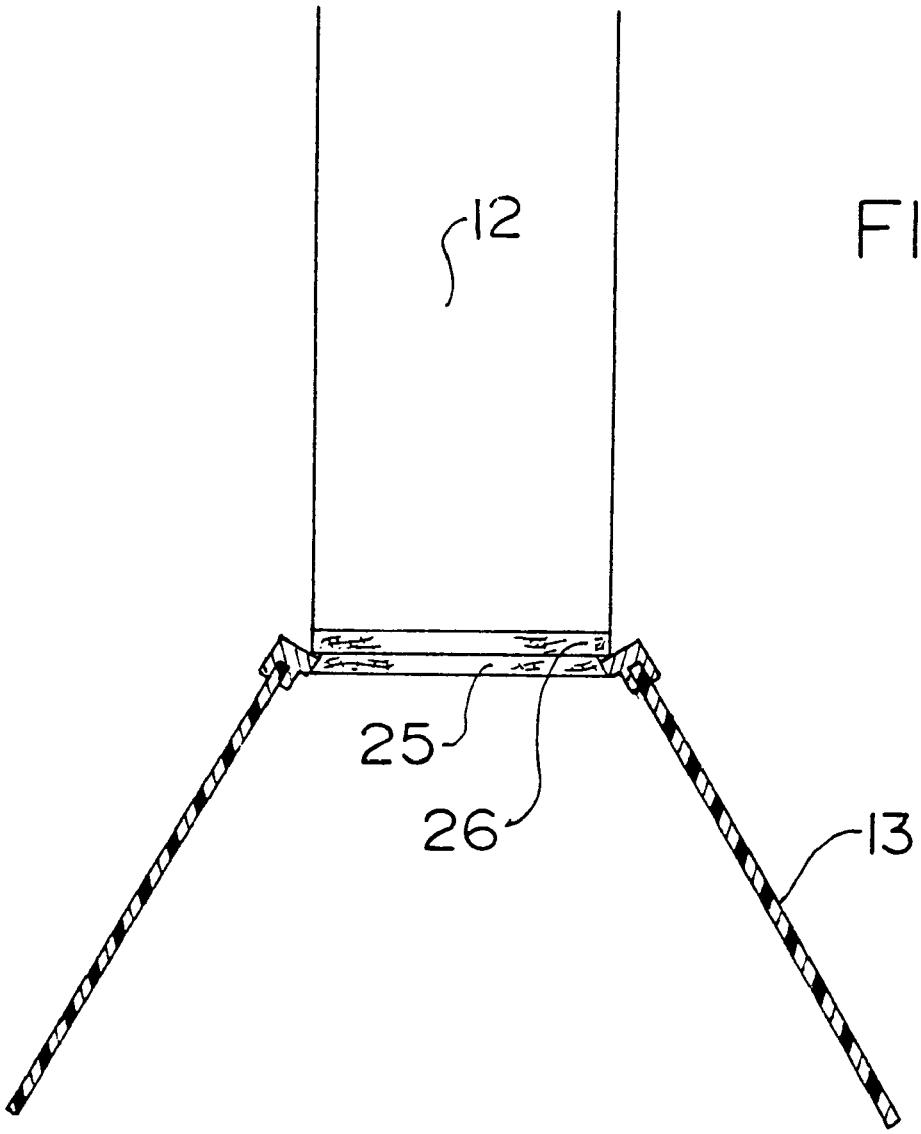
FIG. 13 is a side cross-sectional view of the case shown in FIG. 10 in the open position.

To prevent panels 13 from opening beyond a desired point, two rigid steel arms 21 are pivotally connected to each other and to the side edges of the panels near spring 14 and plate 15. In the closed position, arms 21 pivot into an inverted V shape and allow for panels 13 to be pivoted shut, as shown in FIGS. 2 and 7. In the open position, arms 21 are extended out in a straight line and prevent further opening of panels 13, as shown in FIGS. 5, 6 and 13. The arms also have a protrusion 40 near their connection point to each other, which prevents the arms from folding downward into a V.

Frame 12 is also preferably equipped with a plurality of resilient spacing brackets 22 extending sideward from the bottom section of frame 12, as shown in FIG. 9. Spacing brackets 22 ensure that frame 12 slides smoothly within case assembly 11, by occupying the extra space between the side panels of frame 12 and flanges 16. Various other ways of filling the empty space to ensure smooth sliding could also be used, such as ball bearings.

Figure 10:
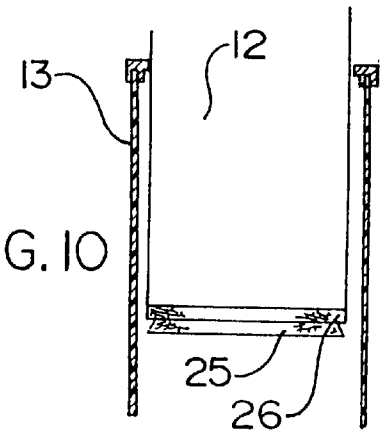
FIG. 10 is a sectional view along line 10—10 of the case as shown in FIG. 7.

To keep frame 12 in an extended position for display of a window, a plank 25 is mounted to the bottom section of frame 12, as shown in FIGS. 6, 9 and 10. The side sections of frame 12 extend below the bottom section of frame 12, so that plank 25 is recessed in frame 12. The top of plank 25, which is affixed to the bottom of frame 12, is narrower than frame 12. Plank 25 has outwardly beveled edges, which can be seen in FIG. 10 so that the bottom of plank 25 is wider than the top. These beveled edges create a groove 26 between the bottom of plank 25 and the bottom of frame 12.

When frame 12 is raised up and out of case assembly 11, the bottom of panels 13 pivot outward and the top edges of panels 13 pivot inward by the force of spring 14. As the bottom of frame 12 passes by the top edges of panels 13, the top edges of panels 13 engage groove 26 and lock frame 12 in an extended position, as shown in FIG. 6. No amount of downward pressure can cause frame 12 to be pushed back into case assembly 11.

To re-insert frame 12 into case assembly 11, panels 13 are pressed together below spring 14 and plate 15, which causes the top edges of panels 13 to release groove 26 and allow frame 12 to slide down within case assembly 11.

The present invention provides a sturdy, durable and easy-to use carrying case for displaying replacement windows. The panels protect the window during transportation and storage, and provide a convenient stand for displaying the window. The beveled plank 25 attached to frame 12 provides an extremely simple and durable solution to the problem of keeping frame 12 in an extended position.

Figure 12:
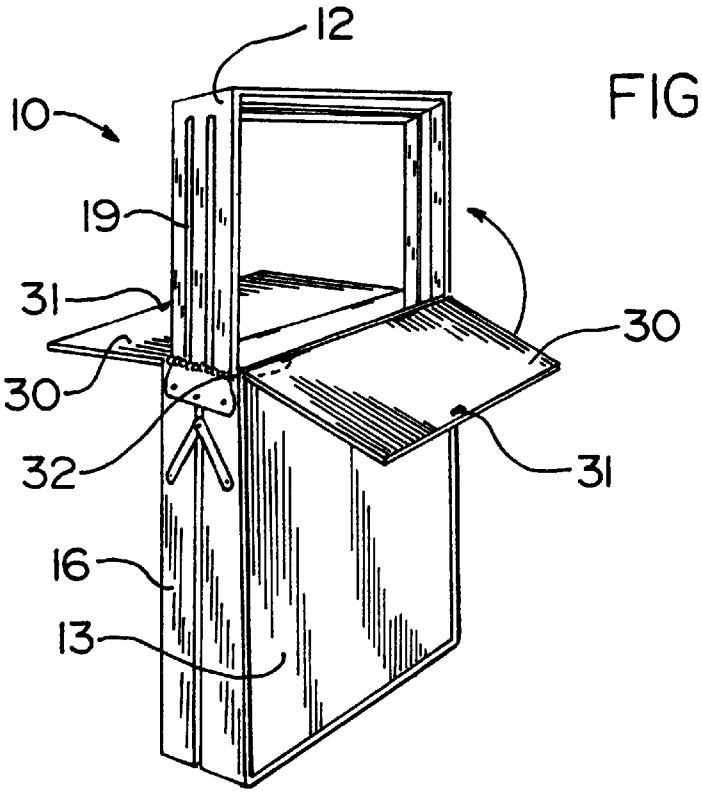
FIG. 12 is a perspective view of the case as shown in FIG. 11 in the closed position.
Figure 11:
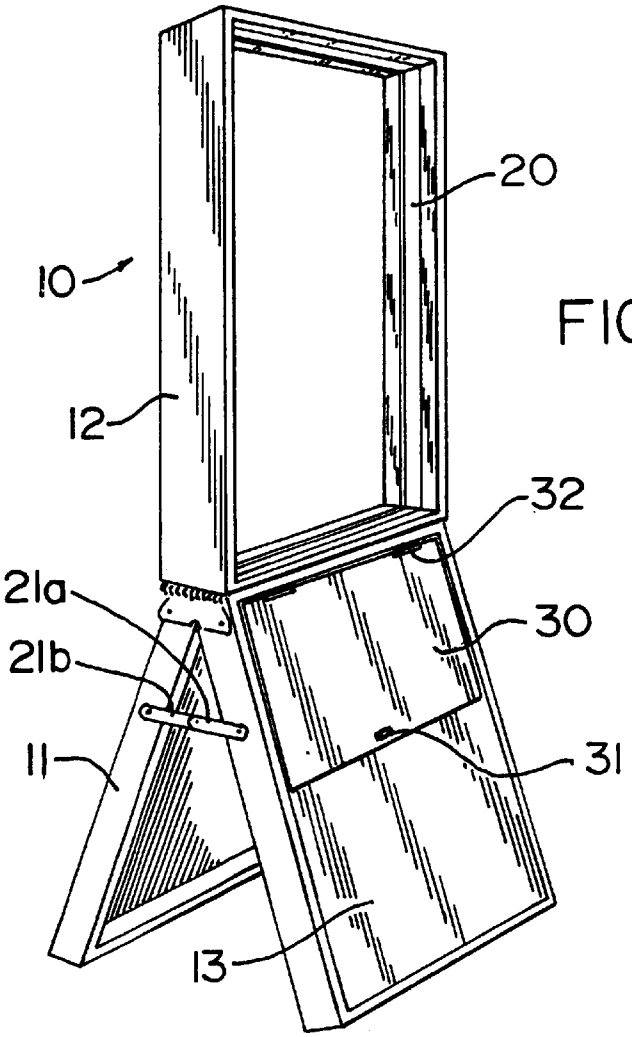
FIG. 11 is a perspective view of an alternative embodiment of the case according to the invention in the open position.

FIGS. 11 and 12 show an alternative embodiment of the case according to the invention. This embodiment is intended for use with larger windows, in which raising the entire height of the window out of a similarly-dimensioned case assembly would be too awkward and heavy for the salesperson.

Thus, to solve this problem, case assembly 11 is dimensioned to be shorter than frame 12, and can be up to 50% shorter than frame 12. Thus, when frame 12 is lowered within case assembly 11, a portion of frame 12 extends above case assembly 11, as shown in FIG. 12.

To protect this portion of frame 12 during transportation and storage, cover flaps 30 are provided. Cover flaps 30 are connected with hinges 32 to the top edge of panels 13 and rest flush with panels 13 when frame 12 is fully extended. When frame 12 is lowered into case assembly 11, as shown in FIG. 12, flaps 30 can be raised up to cover the extended portion of frame 12. Cover flaps 30 are equipped with fasteners 31 on their top edges to fasten flaps 30 to frame 12. Fastener 31 can be any type of fastener, such as a snap, latch, hook, or even looped Velcro-type fastener.

This way, even very large windows can be transported and displayed without causing undue discomfort or inconvenience to the salesperson or customer.

Accordingly, while only several embodiments of the present invention have been shown and described, it is obvious that many changes and modifications may be made thereunto without departing from the spirit and scope of the invention according to the appended claims.

What is claimed is:

1. A display case for a replacement window, comprising:

a case assembly comprising a front panel and a rear panel, each panel having an outer surface, an inner surface, two side edges and a top edge and being connected to each other near said top edge via hinged connections, each side edge having an inwardly-directed flange connected thereto;

a frame for receiving a replacement window and slidably inserted within said case assembly, said frame comprising two side sections each having an external surface, a top section and a bottom section, each side section having at least one longitudinally-extending channel on its external surface for sliding engagement with a flange on the case assembly;

means for preventing opening of the panels at the hinged connection beyond a predetermined maximum point;

a plank attached to said bottom section of said frame and extending along a length of said bottom section, said plank having outwardly beveled longitudinal edges so as to create grooves between the bottom section of the frame and the bottom of the beveled edges;

such that sliding the frame out of the case assembly and opening the panels at the hinged connections to their maximum point causes the top edges of the panels to engage the grooves and lock the frame in an extended position, and wherein closing the panels releases the grooves and allows the frame to slide within the case assembly.

2. The display case according to claim 1, further comprising at least one handle attached to at least one side of the case assembly.

3. The display case according to claim 1, wherein the hinged connections are comprised of a steel plate pivotally mounted to the side edges of each of the two panels, and a spring connecting the two panels near their top edges, said spring forcing the panels to an open position when the frame is extended out of the case assembly.

4. The display case according to claim 1, further comprising a plurality of resilient spacing brackets attached to the side sections of the frame for facilitating smooth sliding of the frame within the case assembly.

5. The display case according to claim 1, wherein there are two channels on each side section, each channel engaging a flange on a panel.

6. The display case according to claim 1, wherein the frame is dimensioned to slide completely within the case assembly.

7. The display case according to claim 1, wherein the means for preventing the opening of the panels at the hinged connections beyond a predetermined maximum point comprises two rigid arms pivotally mounted to each other at one respective end thereof, and pivotally mounted to side edges of opposite panels at a second respective end thereof.

8. The display case according to claim 1, wherein the flanges are made of steel.

9. The display case according to claim 1, further comprising a cover flap hingedly connected to the top edge of each panel, and means on each cover flap for releasably securing said cover flap to the frame, wherein the side sections of said frame are longer than the height of said panels, such that when the frame is slid within the case assembly, the cover flaps are raised and secured to the frame to cover any portion of the frame remaining outside the case assembly.

10. The display case according to claim 1, wherein the frame has an inside surface having a channel for securing a replacement window therein.

11. The display case according to claim 1, further comprising a handle attached to the top section of the frame to enable sliding of the frame in and out of the case assembly.

* * * * *